US010883070B2

(12) United States Patent
Shcherbakov et al.

(10) Patent No.: US 10,883,070 B2
(45) Date of Patent: Jan. 5, 2021

(54) STABLE BLEACHING COMPOSITION

(71) Applicant: Firmenich SA, Geneva (CH)

(72) Inventors: Denis Shcherbakov, Plainsboro, NJ (US); Christian Starkenmann, Geneva (CH); Pierre-Etienne Bouquerand, Geneva (CH); Marco Pacchiani, Geneva (CH); Valery Normand, Plainsboro, NJ (US)

( * ) Notice: Subject to any disclaimer, the term of this patent is extended or adjusted under 35 U.S.C. 154(b) by 69 days.

(21) Appl. No.: 16/099,518

(22) PCT Filed: May 22, 2017

(86) PCT No.: PCT/EP2017/062255
§ 371 (c)(1),
(2) Date: Nov. 7, 2018

(87) PCT Pub. No.: WO2017/202763
PCT Pub. Date: Nov. 30, 2017

(65) Prior Publication Data

US 2019/0161710 A1 May 30, 2019

Related U.S. Application Data

(60) Provisional application No. 62/340,117, filed on May 23, 2016.

(51) Int. Cl.

| | |
|---|---|
| ***C11D 7/02*** | (2006.01) |
| ***C11D 7/04*** | (2006.01) |
| ***C11D 7/54*** | (2006.01) |
| ***C11D 17/04*** | (2006.01) |
| ***C11D 3/50*** | (2006.01) |

(Continued)

(52) U.S. Cl.
CPC ..... *C11D 3/505* (2013.01); *C11D 3/222* (2013.01); *C11D 3/226* (2013.01); *C11D 3/3951* (2013.01); *C11D 3/3953* (2013.01); *C11D 7/02* (2013.01); *C11D 7/04* (2013.01); *C11D 7/10* (2013.01); *C11D 7/268* (2013.01); *C11D 7/28* (2013.01); *C11D 11/0017* (2013.01); *C11D 11/0023* (2013.01); *C11D 17/0039* (2013.01); *C11D 17/06* (2013.01)

(58) Field of Classification Search
CPC .. C11D 7/02; C11D 7/04; C11D 7/268; C11D 7/28; C11D 17/0039; C11D 17/06
USPC ..... 510/302, 379, 380, 441, 444, 446, 474, 510/508, 509, 510, 511
See application file for complete search history.

(56) References Cited

U.S. PATENT DOCUMENTS

| | | | | |
|---|---|---|---|---|
| 1,945,913 | A | 2/1934 | Remele | |
| 2009/0258812 | A1* | 10/2009 | Sengupta | A61K 8/042 510/475 |
| 2013/0203863 | A1* | 8/2013 | Le-Thiesse | A61K 8/33 514/772 |

FOREIGN PATENT DOCUMENTS

| | | | |
|---|---|---|---|
| WO | 2007096790 | A1 | 8/2007 |
| WO | 2015189296 | A1 | 12/2015 |
| WO | 2015192822 | A1 | 12/2015 |

OTHER PUBLICATIONS

International Search Report and Written Opinion for PCT Application No. PCT/EP/2017/062255, dated Jul. 26, 2017.

* cited by examiner

*Primary Examiner* — Gregory R Delcotto
(74) *Attorney, Agent, or Firm* — Paul Zagar

(57) ABSTRACT

This invention relates to a bleaching composition comprising hypochlorite-based bleach particles and moisture-sensi- (Continued)

tive particles encapsulating an oil within starch or starch-derivative matrix, the composition being surprisingly stable toward degradation of the starch upon storage.

9 Claims, 5 Drawing Sheets

(51) Int. Cl.

| | |
|---|---|
| ***C11D 3/395*** | (2006.01) |
| ***C11D 17/00*** | (2006.01) |
| ***C11D 17/06*** | (2006.01) |
| ***C11D 3/22*** | (2006.01) |
| ***C11D 7/26*** | (2006.01) |
| ***C11D 7/10*** | (2006.01) |
| ***C11D 7/28*** | (2006.01) |
| ***C11D 11/00*** | (2006.01) |

STABLE BLEACHING COMPOSITION

CROSS-REFERENCE

This application is a 371 filing of International Patent Application PCT/EP2017/062255 filed 22 May 2017, which claims the benefit of U.S. provisional patent application 62/340,117, filed 23 May 2016, the contents of which are hereby incorporated by reference in their entirety.

TECHNICAL FIELD

This invention relates to a bleaching composition comprising hypochlorite-based bleach particles and moisture-sensitive particles encapsulating an oil within starch or starch-derivative matrix, the composition being surprisingly stable toward degradation of the starch upon storage.

SUMMARY

One aspect presented herein provides a bleaching composition comprising: a water sensitive starch, or starch derivative, based particle comprising an oil encapsulated/dispersed within the particle, and a bleach particle comprising a dry mixture of a hypochlorite alkaline earth salt and other mineral particles.

In one aspect, the starch, or starch derivative, is sodium octenyl succinyl starch or octenylbutanedioate amylodextrin.

In one aspect, the starches or starch derivatives are characterized by a molecular weight higher than 20,000 Da.

In one aspect, the oil is a perfume.

In one aspect, the bleach particle is a chlorinated lime particle, comprising calcium hypochlorite [$Ca(OCl)_2$], dibasic calcium hypochlorite [$Ca_3(OCl)_2(OH)_4$], and dibasic calcium chloride [$Ca_3Cl_2(OH)_4$].

In one aspect, the bleaching composition comprises water sensitive particle in amounts comprised between about 10% and 0.1% w/w relative to the total weight of the composition.

In one aspect, the bleaching composition comprises the bleach particle in amounts comprised between about 90% and 99.9% w/w relative to the total weight of the composition.

One aspect presented herein provides a consumer product comprising a bleach composition according to some aspects of the present invention.

In one aspect, the consumer product is a fabric care product or a home care product.

DESCRIPTION OF THE INVENTION

Figure 1:
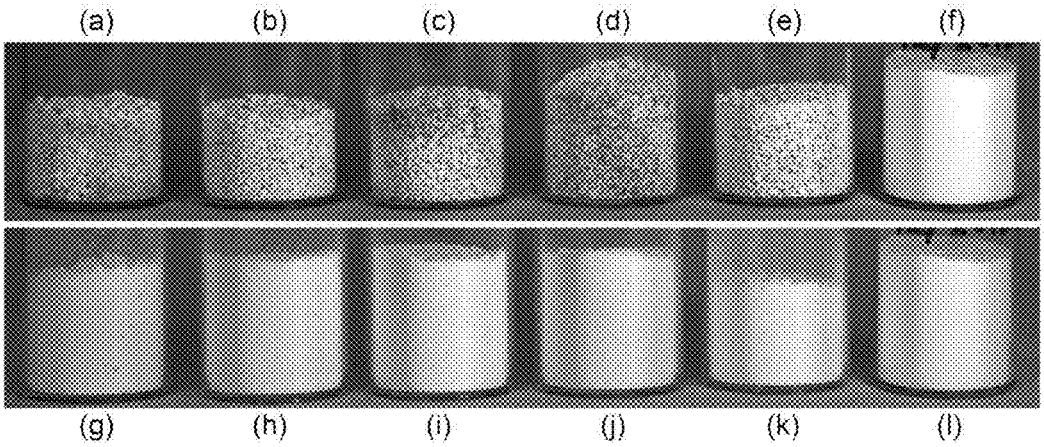
FIG. 1 shows the oxidative stability of bleach compositions according to some aspects of the present invention.

The present invention relates about a bleaching composition comprising:

- a water sensitive starch, or starch derivative, based particle comprising an oil encapsulated/dispersed within the particle, and
- a bleach particle comprising a dry mixture of a hypochlorite alkaline earth salt as specified below.

The composition has proved to be particularly stable against the oxidation of the starch, maintaining thus all its properties over shelf life.

For the sake of clarity, by the expression "water sensitive particle" it is meant here a particle that can be at least partially soluble or dispersed into water based medium, e.g. water or mix of solvent comprising at least 50% of water.

According to a particular embodiment of the invention, water sensitive particles are particles obtained by spray-drying and/or fluidized-bed encapsulation processes. The processes are well known to a person skilled in the art.

According to the present invention, the perfume ingredient or composition is dispersed in a carrier material. Preferably, the carrier material comprises carbohydrates. For example, the carrier material comprises mono-, oligo- and/or polysaccharides, wherein the prefixes oligo- and poly are as defined below.

In an embodiment of the present invention, the carrier material comprises a monomeric, oligomeric or polymeric carrier material, or mixtures of two or more of these. An oligomeric carrier is a carrier wherein 2-10 monomeric units are linked by covalent bonds. For example, if the oligomeric carrier is a carbohydrate, the oligomeric carrier may be sucrose, lactose, raffinose, maltose, trehalose, fructo-oligosaccharides, to name a few examples only. Examples of a monomeric carrier material are glucose, fructose, mannose, galactose, arabinose, fucose, sorbitol, mannitol, for example.

Polymeric carriers have more than 10 monomeric units that are linked by covalent bonds. Non limiting examples of the latter include polyvinyl acetate, polyvinyl alcohol, dextrins, maltodextrins, natural or modified starch, vegetable gums, pectins, xanthanes, alginates, carrageenans or yet cellulose derivatives such as for example carboxymethyl cellulose, hydroxypropylmethylcellulose, methylcellulose or hydroxyethylcellulose, and generally all materials currently used for encapsulation of volatile substances. Preferably, the polymeric carrier comprises modified starch, such as, for example, alkenyl-succinated starch. Most preferably it comprises modified starch and maltodextrin.

For the sake of clarity, by the expression "modified starch" it is intended here that the carrier or matrix, which is present in the composition of the present invention, contain in addition to food starch or modified food starch, such as sodium octenyl succinyl starch or octenylbutanedioate amylodextrin (Capsul™), a polysaccharide gum such as gum Arabic, or a maltodextrin, or mixtures thereof as long as the produced perfume delivery system is not releasing encapsulated oil when submitted to 60% relative humidity air at 37° C.

As non-limiting examples of food starches or modified food starch derivatives one may cite native starches, pregelatinized starches, resistant starches, modified starches, maltodextrins, corn syrup dextrins, soluble fibers (Nutriose), Hydrogenated Starch Hydrolysates.

According to any embodiment of the invention, the preferred starches or starch derivatives are octenylsuccinated starches: starch from any botanical origin having been chemically modified by grafting octenylsuccinate groups to improve its lipophilicity and its emulsifying properties. As typical non-limiting example dextrin dioctenylsuccinate (origin: Ingredion, USA=Capsul®; Cargill, USA=EmCap®;

Tate & Lyle, USA=Mira-Cap®; Grain Processing, USA=Pure-Cote®; Roquette, France=Cleargum® CO 01). According to any embodiment of the invention, the preferred starches or starch derivatives are characterized by a Mw higher than 20,000 Da and a polydispersity around 7.0.

According to any embodiment of the invention, the preferred starches or starch derivatives are characterized by a degree of substitution of about 2% to 6%, or even of about 4%, for the food grade available cheap modified starch.

According to any embodiment of the invention, the water sensitive particle may further comprise fireproofing agents, e.g. sodium silicate, potassium silicate, sodium carbonate, sodium hydrogencarbonate, monoammonium phosphate or carbonate, diammonium phosphate, mono-, di- or trisodium phosphate, sodium hypophosphite, melamine cyanurate, chlorinated hydrocarbons and mixtures thereof. For instance the fireproofing agents can be present in amounts ranging from 5 to 15% by weight of fireproofing agent relative to the dry weight of the particle.

According to any embodiment of the invention, the oil encapsulated/dispersed may be any substance which is required to be separated from the outside environment and/or from other components of the invention's composition until addition of the composition to aqueous medium, e.g. upon use.

In particular, the encapsulated substance can be a liquid organic material (at room temperature) and poorly soluble in water (e.g. log $P_{o/w}$, >0.1), with non-limiting examples including perfumes, flavors or oily cosmetic ingredients.

According to any embodiment of the invention, the encapsulated/dispersed oil is a perfume, which can be a pure ingredient or a composition of matter comprising several ingredients.

The perfume can thus be a perfuming composition comprising:

i) at least one perfuming ingredient, preferably a perfumery base; and ii) optionally a perfumery carrier and/or at least one perfumery adjuvant.

By "perfumery carrier" we mean here a material which is practically neutral from an olfactive point of view, i.e. that does not significantly alter the organoleptic properties of perfuming ingredients. The carrier may be a liquid or a solid.

As liquid carrier one may cite, as non-limiting examples, an emulsifying system, i.e. a solvent and a surfactant system, or a solvent commonly used in perfumery. A detailed description of the nature and type of solvents commonly used in perfumery cannot be exhaustive. However, one can cite as non-limiting examples solvents such as butylene or propylene glycols, glycerol, dipropyleneglycol and its monoether, 1,2,3-propanetriyl triacetate, dimethyl glutarate, dimethyl adipate 1,3-diacetyloxypropan-2-yl acetate, diethyl phthalate, isopropyl myristate, benzyl benzoate, benzyl alcohol, 2-(2-ethoxyethoxy)-1-ethano, tri-ethyl citrate or mixtures thereof, which are the most commonly used. For the compositions which comprise both a perfumery carrier and a perfumery base, other suitable perfumery carriers than those previously specified, can be also ethanol, water/ethanol mixtures, limonene or other terpenes, isoparaffins such as those known under the trademark Isopar® (origin: Exxon Chemical) or glycol ethers and glycol ether esters such as those known under the trademark Dowanol® (origin: Dow Chemical Company), or hydrogenated castors oils such as those known under the trademark Cremophor® RH 40 (origin: BASF).

By "perfumery base" we mean here a composition comprising at least two perfuming ingredients.

According to any embodiment of the invention, the perfuming composition comprises at least a perfumery base comprising at least three, four perfuming ingredients.

The nature and type of the perfuming co-ingredients present in the base do not warrant a more detailed description here, which in any case would not be exhaustive, a person skilled in the art of perfumery being able to select them on the basis of his general knowledge and according to intended use or application and the desired organoleptic effect. In general terms, these perfuming co-ingredients belong to chemical classes as varied as alcohols, lactones, aldehydes, ketones, esters, ethers, acetates, nitriles, terpenoids, nitrogenous or sulphurous heterocyclic compounds and essential oils, and the perfuming co-ingredients can be of natural or synthetic origin or even pro-perfumes (i.e. compounds which upon degradation liberate a perfuming ingredient).

A perfumery base according to the invention may not be limited to the above mentioned perfuming ingredients, and many other of these co-ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that the co-ingredients may also be compounds known to release in a controlled manner various types of perfuming compounds.

By "perfumery adjuvant" we mean here an ingredient capable of imparting additional added benefit such as a color, a particular light resistance, chemical stability, etc. A detailed description of the nature and type of adjuvant commonly used in perfuming bases cannot be exhaustive, but it has to be mentioned that the ingredients are well known to a person skilled in the art. However, one may cite as specific non-limiting examples the following: viscosity agents (e.g. surfactants, thickeners, gelling and/or rheology modifiers), stabilizing agents (e.g. preservatives, antioxidants, heat/light and or buffers or chelating agents, such as BHT), color agents (e.g. dyes and/or pigments), preservatives (e.g. antibacterial or antimicrobial or antifungal or anti irritant agents), abrasives, skin cooling agents, fixatives, insect repellants, ointments, vitamins and a mixture thereof.

It is understood that a person skilled in the art is perfectly able to design optimal formulations for the desired effect by admixing the above mentioned components of a perfuming composition, simply by applying the standard knowledge of the art as well as by trial and error methodologies.

According to any embodiment of the invention, the oil encapsulated/dispersed may represent from about 20 to 60% w/w of the overall weight of the water sensitive particle, more preferably between 30% to 60% w/w, or even between 35 to 55%. According to any embodiment of the invention, the water sensitive particle may be characterized by a size comprised between 5 μm ($5\times10^{-6}$ m) and 150 μm ($150\times10^{-6}$ m) in diameter.

According to any embodiment of the invention, the bleaching composition comprises water sensitive particle in amounts comprised between about 10% and 0.1% w/w relative to the total weight of the composition, or even between about 5% and 0.5% w/w.

Another essential element of the invention is a bleach particle comprising a dry mixture of a hypochlorite alkaline earth salt and other mineral particles.

According to any embodiment of the invention, the bleach particle is a chlorinated lime particle, comprising but not limited to calcium hypochlorite [$Ca(OCl)_2$], dibasic calcium hypochlorite [$Ca_3(OCl)_2(OH)_4$], and dibasic calcium chloride [$Ca_3Cl_2(OH)_4$], and produced by the chemical process outlined in U.S. Pat. No. 1,945,913.

According to any embodiment of the invention, the the bleach particle may be characterized by a diameter between 0.1 μm ($0.1\times10^{-6}$ m) and 400 μm ($400\times10^{-6}$ m) for dry powder.

According to any embodiment of the invention, the hypochlorite salt may be characterized by an elemental content of Ca/O/Cl ratio comprised between 1/5/1 and 1/3/1, or even between 1/3.5/1 and 1/4.5/1.

According to any embodiment of the invention, the the bleach particle may be characterized by a content of available Chlorine comprised between 20% and 40% w/w, preferably between 30% and 38% w/w.

According to any embodiment of the invention, the the bleach particle may further contain hydrated and/or non-hydrated Calcium oxide(s), Calcium carbonate(s), and/or Calcium hydroxide(s).

According to any embodiment of the invention, the the bleach particle may comprise less than 5% w/w of moisture, preferably less than 2% w/w of moisture, or most preferably less than 1% w/w of moisture.

The bleach particles are a known material per se and has been described in various literature, for example in U.S. Pat. No. 1,945,913, and can be referred to as tropical bleach or stable bleaching powder in the context of this invention.

According to any embodiment of the invention, the bleaching composition comprises the water sensitive particle in amounts comprised between about 0.1% and 10% w/w relative to the total weight of the composition, or even between about 0.5% and 5% w/w.

According to any embodiment of the invention, the bleaching composition comprises the bleach particle in amounts comprised between about 90% and 99.9% w/w relative to the total weight of the composition, or even between about 95% and 99.5% w/w.

According to any embodiment of the invention, the composition of the invention can be prepared by:

i) spray drying the starch, or starch derivative with the oil encapsulated/dispersed so as to form the water sensitive particle; and ii) blending the water sensitive particle with the bleach particle.

To produce a water sensitive particle containing an oil, such as a perfume, a solution or dispersion of starch, or starch derivative, in water is prepared with an amount of perfume (e.g. an amount as cited above), then the emulsion thus obtained is then spray-dried using conventional spray drying techniques, e.g. a spray-dryer with rotary atomizer, with an inlet temperature above 200° C., typically around 240° C., and an outlet temperature below 120° C., typically 100° C., or below.

The invention composition has the advantage of being stable upon storage despite the presence of the bleach and does not provoke undesired decrease of the bleaching power or oxidative coloring of the starch/oil.

Therefore, the invention's composition can be advantageously used in all kind of consumer product wherein the presence of bleach and of oil, such as a perfume, is highly desirable.

Consequently, another object of the present invention is represented by a consumer product comprising an invention's composition, as defined above.

The nature and type of the constituents of the consumer product do not warrant a more detailed description here, which in any case would not be exhaustive, the skilled person being able to select them on the basis of his general knowledge and according to the nature and the desired effect of the product.

Non-limiting examples of suitable perfuming consumer product can be any consumer product requiring a solid bleach, such as for example a fabric care product, such as a solid bleach; or a home care product, such as a hard-surface (e.g. a floor, bath or sanitary) detergent.

The proportions in which the composition according to the invention can be incorporated into the various aforementioned articles or compositions vary within a wide range of values. These values are dependent on the nature of the article to be perfumed and on the desired organoleptic effect as well as the nature of the co-ingredients in a given base when the composition according to the invention is mixed with perfuming co-ingredients, solvents or additives commonly used in the art.

For example, in the case of perfuming compositions, a consumer product incorporating these compositions can contain between 0.001% and 100% of the composition by weight, percentage being relative to the weight of the consumer product.

DESCRIPTION OF THE FIGURE

FIG. 1. (a-d): mixtures of water-sensitive particles and high-test (pure) calcium hypochlorite bleach (65% available Chlorine) blended at 1, 2, 5, and 10% w/w, respectively; (e): control, high-test calcium hypochlorite particles; (f): control, water-sensitive particles; (g-j): mixtures of water-sensitive particles and the invention bleaching particle (36% available Chlorine) blended at 1, 2, 5, and 10% w/w, respectively; (k): control, stable bleaching powder particles; (l): control, water-sensitive particles.

EXAMPLES

The invention will now be described in further detail by way of the following examples:

Example 1

Preparation of an Invention's Bleaching Composition

1) Preparation of the Water Sensitive Particle:

3.8 kg batches of spray-feed have been processed at pilot scale using Niro Mobil Minor spray-drier (GEA Denmark) according to the following formulations:

| Item | Spray-feed (g) | Dry formulation (%) |
|---|---|---|
| Capsul ® OSS | 1000 | 50 |
| Perfume oil | 1000 | 50 |
| City water | 1800 | |
| | 3800 | 100 |

The modified starch was dispersed in hot water (30° C.) water using a propeller-head stirrer, the day before to ensure a complete dissolution. After an overnight period the perfume was dispersed into a clear no more milky solution using Ultra Turax™ homogenizer. The resulting emulsion has a viscosity about 320 mPas. The inlet temperature was maintained at 220° C. and the emulsion was fed at a rate sufficient to maintain an outlet temperature at 85° C. The drying gas throughput was about 85 kg/h. The 1 mm nozzle was kept at 60° C. with nitrogen throughput between 10 to 11 kg/h. About 1250 g of powder was collected.

2) Preparation of Composition

The composition containing water sensitive particles, produced by spray-drying as detailed above, and this invention's bleaching particles (also referred to as stable bleaching powder or tropical bleach) was produced as follows. Approximately 2% of the total amount of bleaching powder needed for the final composition is weighed and pre-mixed with the entire portion of the water sensitive particles needed for the final composition. Pre-mixed powder is then added to the remaining quantity of this invention's bleaching particle and blended for 1 minute in a ribbon blender.

With a similar procedure where produced various composition (as per FIG. 1), and their stability tested. Starches and modified starches are expected to brown in strongly oxidative environments, which affords ready visual identification of oxidative degradation of water-sensitive particles in bleach powders.

Stability of the water-sensitive particles comprising perfume oil and Capsul® OSS was evaluated against two types of bleach particles: (1) stable bleaching powder particles (chlorinated lime, 36% available Chlorine) that is a necessary component of this invention and (2) full-strength (pure, high-test) Calcium Hypochlorite particles (65% available chlorine).

Water-sensitive particles were dry-blended with the bleach particles of the above types individually at proportions of 1%, 2%, 5%, and 10% by weight of the mixture. The mixtures were then stored in closed glass vials at 40° C. and 50% humidity for 3 months.

Since hypochlorite bleach is an oxidizer that does not require an initiator other than moisture, a carbohydrate matrix such as a starch or a starch derivative is expected to undergo visible color change (browning) as a result of oxidation. Furthermore, since both grades of bleach particles described above contain substantial amounts of available Chlorine (36% and 65%), both grades of bleach should cause browning of the water-sensitive particles comprising perfume oil and Capsul® OSS.

As expected and documented in FIG. 1 (*a-f*), the mixture of water-sensitive particles and full-strength (pure, high-test) Calcium Hypochlorite particles did show visible browning for all mixtures with the exception of 2% water-sensitive particles by weight, where water-sensitive particles are completely hidden from view by the bleach particles. The browning effect is increasingly pronounced with increasing weight fraction of water-sensitive particles. Controls are shown in FIG. 1 (*e, f*).

On the other hand, the mixture of water-sensitive particles and stable bleaching powder particles, an example of current invention, did not show visible browning after 3 months at 40° C. and 50% humidity, as documented in FIG. 1 (*g-l*). Surprisingly, no apparent browning is observed at even the highest concentration of 10% water-sensitive particles by weight of the mixture, compared to controls. Controls are shown in FIG. 1 (*k, l*).

To summarize, FIG. 1 demonstrates the oxidative stability of water-sensitive particles in two grades of bleach particles described above and clearly shows oxidative browning in high-test Calcium hypochlorite and no oxidative browning in stable bleaching powder, the latter being the subject of this invention.

Example 2

Characterization of Tropical Bleach Powder (Also Known as Stable Bleaching Powder) and Comparison with Pure (High-Test) Calcium Hypochlorite, $Ca(ClO)_2$ The elemental analysis of the bleach powder was conducted using an Energy Dispersive Spectroscopy (EDS) system combined to a Scanning Electron Microscope (SEM). 5 areas of each powder was imaged and analyzed for its elemental content using a variety of magnification and incident energy. No obvious visual difference was noticeable between the two compositions, however, the elemental analysis was clearly discriminative.

Figure 2:
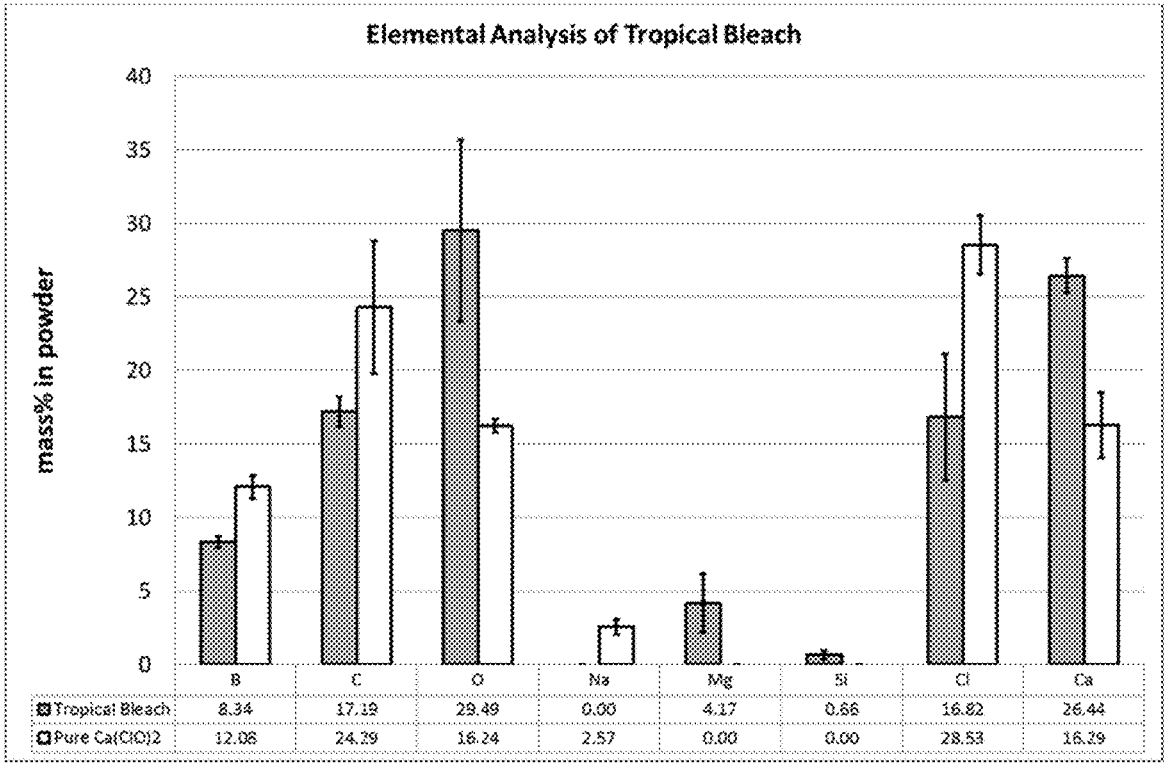
FIG. 2 shows the elemental analysis of bleach compositions according to some aspects of the present invention, expressed as mass %.
Figure 3:
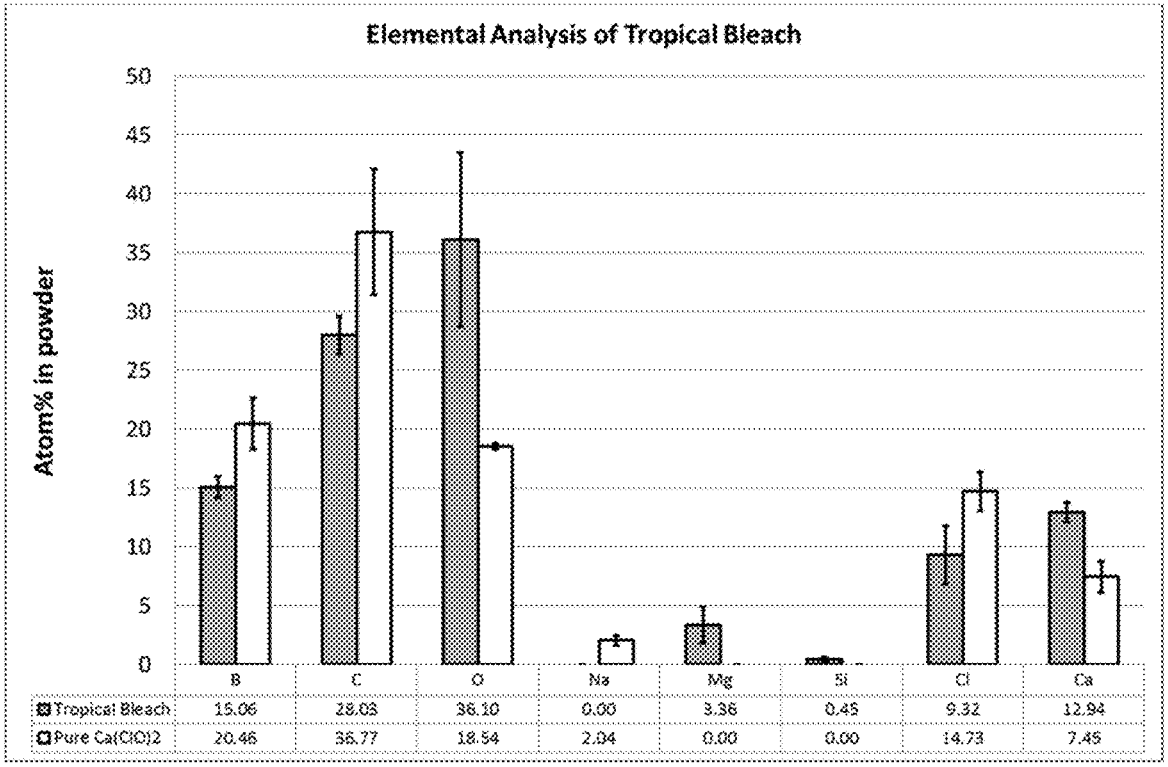
FIG. 3 shows the elemental analysis of bleach compositions according to some aspects of the present invention, expressed as atom %.

Referring to FIGS. 2 and 3, the tropical bleach powder (aka, "stable bleaching powder", "dry Calcium Hypochlorite mixture") was characterized by a mass ratio of Oxygen to Chlorine (O/Cl) of around 2, while pure (high-test) Calcium Hypochlorite was characterized by a mass ratio of O/Cl close to 0.5. Lower chlorine (equivalently, hypochlorite) content in the stable bleaching powder (tropical bleach) tempers its oxidative properties and increases life time (shelf life) of encapsulated perfume, while its low-moisture characteristic stabilizes chlorine and tempers its presence in the headspace.

Furthermore, in terms of atomic percentage, pure (high-test) Calcium Hypochlorite powder measurement is in agreement with the chemical formulation (i.e. 1 Calcium for 2 Chlorides and 2 Oxygen), whereas the Tropical Bleach powder (aka Stable Bleaching Powder) is characterized as 1 Calcium for 1 Chloride and 4 Oxygens because it is a complex mixture of several constituents, resulting from its manufacturing process.

Example 3

Figure 4:
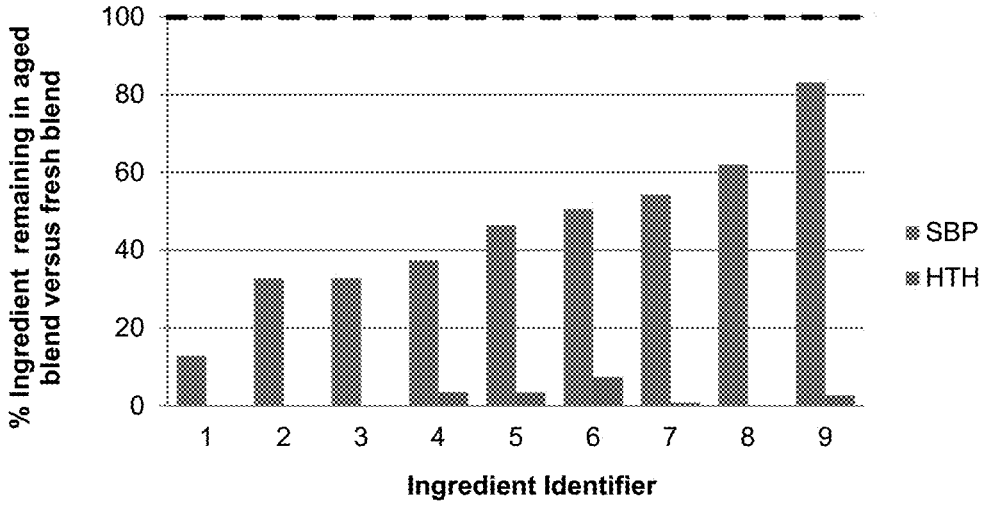
FIG. 4 shows the storage stability of bleach compositions according to some aspects of the present invention.

Stability of a Composition According to Some Embodiments of the Present Invention FIG. 4 shows the storage stability of a perfume formulation, encapsulated by spray-drying, in stable bleaching powder (SBP) and pure (high-test) calcium hypochlorite (HTH) after 3 months at 40° C., compared to freshly blended control perfume formulation. On FIG. 4, perfect ingredient stability is 100%.

The results indicate that pure (high-test) calcium hypochlorite has a profound, destructive impact on the encapsulated perfume during the 3-month aging period, with some of the perfume ingredients completely undetectable.

On the other hand, impact of stable bleaching powder, the subject of this invention, on spray-dry encapsulated perfume after 3 months storage at 40° C. is significantly and unexpectedly improved. In stable bleaching powder, the ingredients in perfume formulation lost on average only 45% of their GC-MS peak area counts due to aging compared to a fresh blend, with aldehydes exhibiting higher-than-average loss and esters exhibiting lower-than-average loss.

The data in FIG. 4 should be treated as qualitative.

To extract perfume ingredients from the dry blend of bleach powder and spray-dried perfume, the blend is dissolved in water and headspace is sampled by solid-phase microextraction (SPME). Once dissolved, the bleach is also activated, and chemical reactions ensue.

Fresh blends of encapsulated perfume and the respective bleach grade (either pure Calcium Hypochlorite or stable bleaching powder) are used as benchmarks, against which percent ingredient remaining are calculated.

Example 4

Performance Composition According to Some Embodiments of the Present Invention

To determine appropriate dosing of water-sensitive particles (spray-dried perfume) in a blend with stable bleaching powder according to some embodiments of the present invention, prototypes were tested by simulating real cleaning applications inside 1.7-$m^3$ ventilated enclosures, simulating a typical toilet cabin. Evaluations of fragrance character and intensity were performed by a Master Perfumer at various doses of spray-dried perfumes in the bleaching powder according to some embodiments of the present invention, as well as at different doses of the product during application. For the perfume formulation tested in this embodiment of the invention, the dose of 1.5% w/w water-sensitive particles in the stable bleaching powder at 10-g total prototype dose was chosen for analysis.

The Master Perfumer noted that the bleaching powder did alter perceived hedonic character of the perfume accord when compared side-by-side with spray-dried perfume reference without bleaching powder added. However, it was unclear if this effect was due to chemical degradation of perfume ingredients in presence of bleach during application or if significant presence of chlorine in the headspace was covering or antagonizing perfume ingredients.

Figure 5:
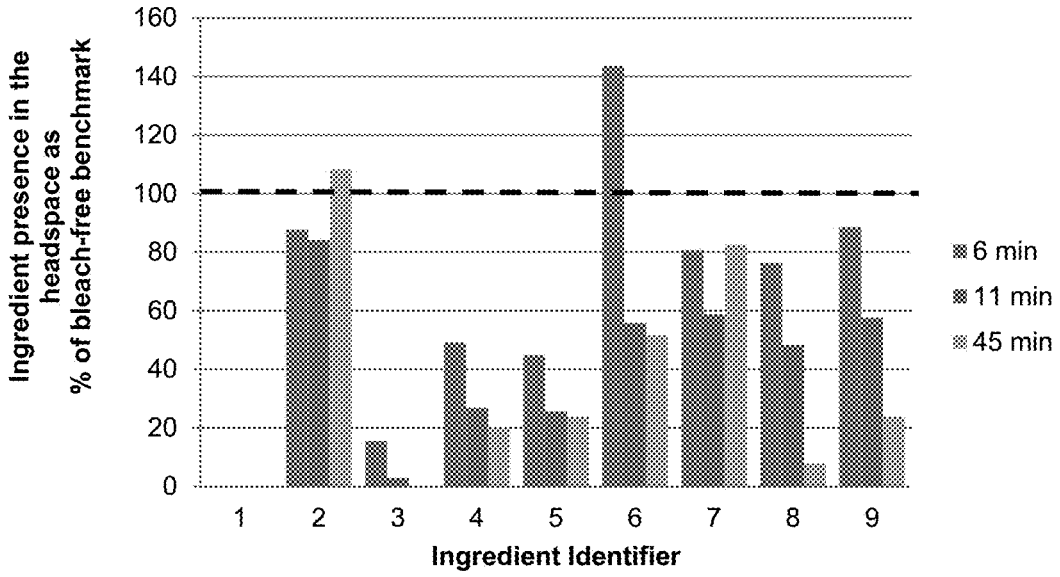
FIG. 5 SPME headspace evaluation of a simulated cleaning application in a shower booth.

Solid phase microextraction (SPME) headspace test was performed in the shower booths at 6, 11, and 45 minutes after initial application of scented bleaching powder containing 1.5% w/w perfume formulation spray-dried powder according to some embodiments of the present invention. The benchmark for this test was spray-dried perfume without bleach, sampled with SPME at same time intervals. FIG. 5 summarizes headspace levels from application of scented bleaching powder as % of same in the benchmark. The data is qualitative.

Only two ingredients in the perfume formulation, used in the current embodiment of the invention, were markedly affected by the presence of stable bleaching powder: ingredient 1, which is a top-note aldehyde, and ingredient 3, which is an alcohol. On the other hand, a heavier aldehyde, ingredient 2, remained stable in the headspace over time versus benchmark. Headspace levels of ketones (ingredients 4, 5, and 7) and a heavy alcohol (ingredient 6) remained stable between 11 and 45 minutes compared to benchmark, while headspace levels of esters (ingredients 8 and 9) exhibited steady and pronounced declines over time. GC-MS chromatograms recorded increasing presence in the headspace of alcohol derivatives of the two esters used in the perfume, confirming their expected hydrolysis. Nevertheless, the esters still deliver sensorial benefit at the time of product application due to the storage stability of water-sensitive particles in the stable bleaching powder base.

What is claimed is:

1. A bleaching composition comprising:

a water sensitive starch, or starch derivative, based particle comprising an oil encapsulated/dispersed within the particle, and a bleach particle comprising a dry mixture of a hypochlorite alkaline earth salt and other mineral particles comprising hydrated and/or non-hydrated calcium oxide, calcium carbonate, and/or calcium hydroxide.

2. The bleaching composition according to claim 1, wherein the starch, or starch derivative, is sodium octenyl succinyl starch or octenylbutanedioate amylodextrin.

3. The bleaching composition according to claim 1, wherein the starches or starch derivatives are characterized by a molecular weight higher than 20,000 Da.

4. The bleaching composition according to claim 1, wherein the oil is a perfume.

5. The bleaching composition according to claim 1, wherein the bleach particle comprises calcium hypochlorite [$Ca(OCl)_2$], dibasic calcium hypochlorite [$Ca_3(OCl)_2(OH)_4$], and dibasic calcium chloride [$Ca_3Cl_2(OH)_4$].

6. The bleaching composition according to claim 1, comprising the water sensitive starch, or starch derivative, based particle in amounts between about 0.1% and 10% w/w relative to the total weight of the composition.

7. The bleaching composition according to claim 1, comprising the bleach particle in amounts between about 90% and 99.9% w/w relative to the total weight of the composition.

8. A consumer product comprising the bleach composition according to claim 1.

9. A consumer product according to claim 8, wherein the consumer product is a fabric care product or a home care product.

* * * * *